United States Patent [19]

Florian

[11] 4,117,052

[45] Sep. 26, 1978

[54] METHOD AND ARRANGEMENT FOR USE IN LINING ARTICLES, PARTICULARLY MELTING OVEN

[75] Inventor: Rudolf Florian, Blomberg, Fed. Rep. of Germany

[73] Assignee: Dörentruper Sand- und Thonwerker G.m.b.H., Dorentrup, Fed. Rep. of Germany

[21] Appl. No.: 782,307

[22] Filed: Mar. 28, 1977

Related U.S. Application Data

[63] Continuation-in-part of Ser. No. 559,865, Mar. 19, 1975, Pat. No. 4,049,759.

[30] Foreign Application Priority Data

Mar. 26, 1976 [DE] Fed. Rep. of Germany ..... 2612912

[51] Int. Cl.[2] ..... F27D 1/16

[52] U.S. Cl. ..... 264/30; 264/110; 264/266; 266/281

[58] Field of Search ..... 264/30, 110, 266; 266/281

[56] References Cited

U.S. PATENT DOCUMENTS

| | | | |
|---|---|---|---|
| 1,917,849 | 7/1933 | Northrup | 266/281 X |
| 3,203,689 | 8/1965 | Hallowell | 266/281 X |

*Primary Examiner*—Thomas P. Pavelko
*Attorney, Agent, or Firm*—Michael J. Striker

[57] ABSTRACT

A method and an arrangement for lining articles are disclosed which are particularly well-suited for use in the lining of melting ovens. The arrangement includes a mold member which has a surface with the configuration corresponding to the face of the inner wall of the oven chamber and comprises a plurality of circumferentially adjacent sections detachably connected to one another. A plurality of circumferentially adjacent flexible plate-like elements of a refractory material are arranged at the surface of the mold member and connected to one another to thereby form a circumferentially complete refractory member. The plate-like elements are connected to one another by refractory adhesive substance. They have adjacent end portions overlapping one another, which portions are connected to one another by the above refractory adhesive substance, and are fixed to one another by adhesive strips. In order to line the oven chamber, the mold member surrounded by the refractory member is arranged inside the chamber so that a space is provided intermediate the refractory member and the face of the article. A lining substance is then admitted into the space, and thereafter the sections of the mold member are disengaged from one another and removed from the refractory member. The lining substance is rigidified while the refractory member remains in the oven and serves as a support for the lining substance, which latter is thus converted into a lining for the oven chamber. The above rigidification of the lining substance is preferably performed by admitting liquid metal into a cold and newly lined oven so that the lining substance simultaneously obtains heat and is subject to metallostatic pressure of the admitted metal.

7 Claims, 2 Drawing Figures

METHOD AND ARRANGEMENT FOR USE IN LINING ARTICLES, PARTICULARLY MELTING OVEN

CROSS-REFERENCE TO RELATED APPLICATIONS

This is a continuation-in-part of my copending application Ser. No. 559,865, filed Mar. 19, 1975, now Pat. No. 4,049,759 and entitled "Method and Arrangement for Use in Lining Articles, Particularly Melting Ovens".

BACKGROUND OF THE INVENTION

This invention generally relates to the lining of articles particularly to a method and arrangement for lining melting ovens.

A procedure for finishing a melting oven is known wherein the melting oven is provided with a refractory lining using a ramming mass which is sintered in order to convert it into a unitary mass constituting the lining of the oven. A metal form or mold member is utilized to confine the initially particulate ramming mass. The mold member is of smaller dimensions than the oven chamber to be lined, is inserted into the oven chamber so that a space is defined between the mold member and the inner wall of the chamber. The ramming mass is poured in this space and thereafter sintered.

It has been proposed to use a mold member which is coated with a refractory composition hardenable at temperatures which do not cause the metal member to be corroded or attacked. The mold member coated with hardened refractory composition is arranged in a melting oven so that a space is provided between the hardened composition and the inner surface of the oven chamber, the ramming mass is admitted into the space defined between the hardened composition and the inner wall of the oven chamber, the mold member is removed from the hardened composition which remains in the chamber as the sole support for the ramming mass which latter is thereafter rigidified to be converted into the lining of the oven. The mold member removed from the hardened composition, can be reused as often as desired.

The rigidification of the lining substance is performed by sintering or vitrification of the ramming mass with use of the following methods proposed in the art. After preparation of the oven, the latter is slowly heated either by an inductively heated metallic insert inserted into the oven, or by gas flame. The above preheating is continued approximately from 4 to 6 hours until the oven is heated to red heat. After the above preheating the thus preheated oven is filled with liquid metal so as to heat the oven approximately from 1300° C. to 1550° C. to thereby sinter the ramming mass. It is also possible to continue the inductive heating of the metallic insert so as to melt the latter. In the latter case, the oven is filled with an additional metallic cover and the lining is sintered at 1550° C. The process of sintering itself is being continued approximately from 1 to 2 hours.

In accordance with the known method and arrangement, the refractory hardenable composition surrounding the mold member and insertable together with the latter into the oven, is made by coating the mold member with the composition in flowable state and hardening the latter on the mold member so as to form a circumferentially complete refractory member. This has the disadvantage that the above method is essentially labor-consuming and time-consuming especially taking into consideration the fact that in order to form a substantially thick layer of the refractory hardenable composition a plurality of thin layers must be successively applied onto the mold member to thereafter be sintered.

The step of rigidification of the ramming mass is also labor-consuming and time-consuming since it requires the above mentioned preheating of the oven to be lined. Due to the fact that the process of lining requires in this case essentially great time, the lining is usually performed only during week ends which results in that sometimes the not lined ovens wait until week-end and are not in operation.

SUMMARY OF THE INVENTION

It is accordingly, a general object of the present invention to provide a novel method and a novel arrangement for use in the lining of articles which avoid the disadvantages of the prior art methods and arrangements.

More particularly, it is an object of the present invention to provide a novel method and arrangement for use in the lining of articles which assure less labor-consuming and time-consuming lining of the articles.

Another object of the present invention is to provide a novel method and a novel arrangement for lining articles with use of a mold member surrounded by a refractory member, which refractory member is made in a simple and non-problematic manner.

A further object of the present invention is to provide a novel method and a novel arrangement for use in the lining of articles which assures less labor-consuming and time-consuming rigidification of a ramming mass forming the lining of the articles.

An additional object of the present invention is to provide a novel method and a novel arrangement for use in the lining of articles which improve the characteristics of the lining, and particularly the solidity of the latter.

The foregoing objects and others which will become apparent hereafter are attained by the present invention. One feature of the present invention is that a refractory member surrounding a mold member and serving as a support for a lining substance to be sintered when the mold member is removed from the refractory member, is formed as a plurality of circumferentially adjacent plate-like elements of a refractory material which elements are connected with one another by the adjacent end portions. Preferably, the elements are connected with one another by a refractory adhesive substance and fixed to one another by adhesive strips. In this case, provision of the mold member with the refractory member is performed very rapidly. Flexibility of the refractory member assures that the latter can be deformed into conformity with the mold member during admission of a ramming mass into the space formed intermediate the refractory member and the inner surface of the article, such as an oven, and thereby ramming impact is effectively transformed to the ramming mass. When adhesive substance is applied to the elements of the refractory member to be connected with one another, it does not hinder deformation of the elements so as to conform the latter with the outer surface of the mold member. However, being hardened, the adhesive substance firmly connects the elements with one another so that the thus formed refractory member surrounding the mold member is substantially rigid.

Another feature of the present invention is that liquid metal is admitted into the interior of the refractory member after removal of the mold member from the former. In this case, no preheating of the oven is needed, and the ramming mass is sintered by heat of the thus admitted liquid metal. The lining of the oven is performed very rapidly and can be done in the beginning or in the middle of the week without reduction of the output. At the same time, metallostatic pressure applied by the liquid metal to the ramming mass prevents the latter from expanding towards the interior of the oven and generating a porous structure, and thereby improves solidity of the oven lining.

The novel features which are considered as characteristic for the invention are set forth in particular in the appended claims. The invention itself, however, both as to its construction and its method of operation, together with additional objects and advantages thereof, will be best understood from the following description of specific embodiments when read in connection with the accompanying drawings.

DESCRIPTION OF THE PREFERRED EMBODIMENTS

As indicated previously, the present invention particularly relates to a method for finishing or lining a melting oven which is provided with its refractory lining by pouring or shaking a ramming material or mass therein using a metal form or mold member, as well as an arrangement for carrying out the method.

According to the method of the invention, the metal mold member is provided by a plurality of flexible plate-like elements of a refractory material connected to one another and forming a circumferentially complete refractory member which surrounds the mold member. The metal mold member surrounded by the refractory member is brought into an oven which is to be lined. Then, the ramming material is poured or shaken into the oven, and the metal mold member is disengaged from the refractory member and taken out of the oven. The refractory member possesses such a high strength, that the operation of rigidifying the ramming material into a firm and coherent body, e.g. the sintering operation, is effected without requiring the metal mold member to remain in the oven. The refractory member retained in the oven after removal of the metal mold member serves as a support for the ramming mass during rigidification of the latter.

Figure 1:
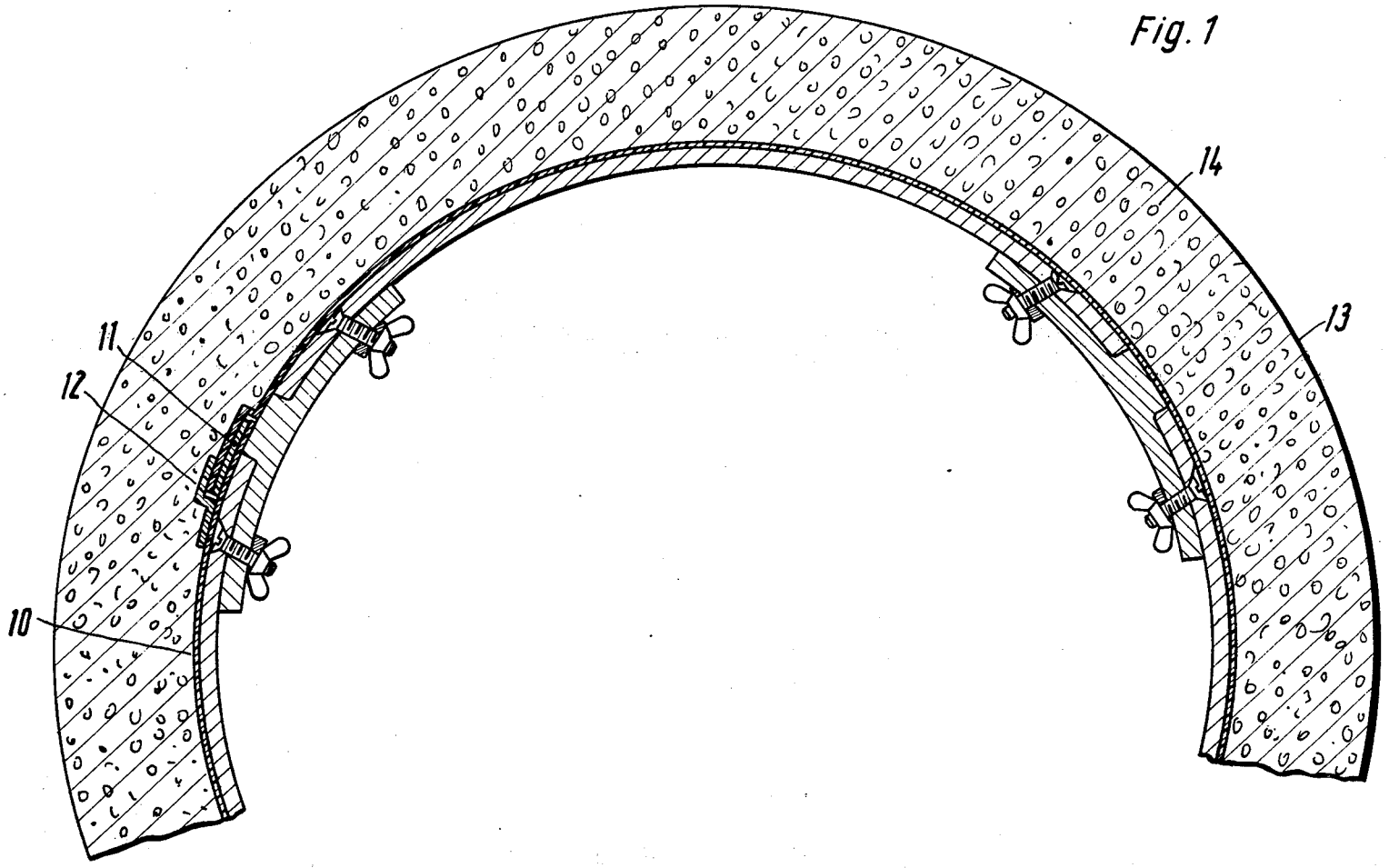
FIG. 1 is a sectional top plan view of an arrangement for use in the lining of ovens inserted into a chamber of a melting oven to be lined.
Figure 2:
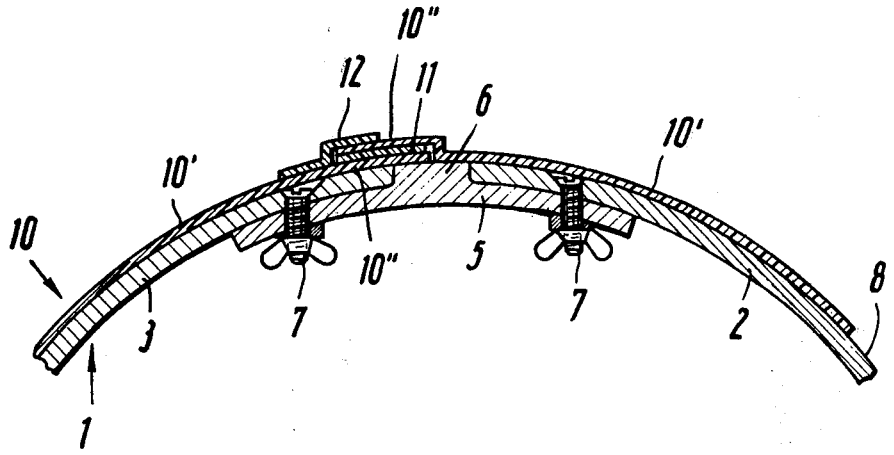
FIG. 2 is an enlarged sectional view of a fragment of an arrangement for use in the lining of articles of the present invention.

Referring now to FIGS. 1 and 2 of the drawing, it is pointed out that these illustrate an arrangement in accordance with the present invention which comprises a metal mold member indicated generally by the reference numeral 1, and the refractory member indicated generally by the reference numeral 10. As more clearly seen in FIG. 2, the particular mold member 1 shown includes three segments identified by the reference numerals 2, 3 and 4, respectively. The mold member further includes an intermediate or connecting sections 5 which serve to unite the segments 2, 3 and 4 into a relatively rigid body. In the present instance, the construction is such that the connecting sections 5 unite the segments 2, 3 and 4 into the form of a cylinder, that is the mold member 1 is of a cylindrical configuration.

Each of the connecting sections 5 is provided with a projection or bulge 6 at the outer end thereof, that is at the end thereof adjacent the respective segments 2, 3 and 4. As best illustrated in FIG. 2, the longitudinally extending edges of the segments 2, 3 and 4 abut against the respectively adjacent projections 6.

Connecting means are provided for connecting the segments 2, 3 and 4 with the connecting sections 5, which are in the form of screws 7. When the connecting sections 5 and the segments 2, 3 and 4 are connected with one another by means of the screws 7, the segments 2, 3 and 4 and the connecting sections 5 together form a cylinder having a substantially smooth outer surface.

As more clearly seen in FIG. 2, the refractory member 10 includes three plate-like elements identified by the reference numerals 10'. The elements are flexible and consist of refractory material such as, for instance, synthetic mica bonded by synthetic resin material. The respective adjacent end portions 10'' of the elements 10' overlap and are connected to one another, by means of a refractory adhesive substance 11. Adhesive strips 12 are provided for rapidly fixing the overlapping end portions 10'' of the elements to one another.

The overlapping end portions 10'' are of the length equal to substantially 60–80 mm. The plate-like elements 10' are flexible so that the degree of their flexibility is sufficient to permit deforming of said elements to thereby conform the same to the outer surface of the mold member. It is advantageous when the degree of flexibility of the elements 10' is such that they can be deformed into conformity to the outer surface of the mold member by the ramming substance while the latter is rammed in the space defined between the refractory member 10 and the inner face of a melting oven. The refractory adhesive substance for connecting the elements to one another is preferably sufficiently movable before being hardened so as not to hinder deformation of the elements into conformity to the outer surface of the mold member. The refractory adhesive substance comprises, for instance, clay, water and a ceramic binder such as for instance aluminum phosphate.

When the plate-like elements 10' are connected with one another by the refractory adhesive substance 11 and fixed by the adhesive strips 12, the elements 10' together form the cylindrical refractory member 10 outwardly surrounding the metal mold member 1.

Referring now to FIG. 1, it is pointed out that this illustrates the lining of a melting oven 13, using a ramming material. It will be seen that the melting oven 13 has been shown as having a cylindrical configuration. It will be appreciated that the melting oven 13 has been finished to a point where it is ready to be provided with a refractory lining interiorly thereof.

In order to line the interior of the melting oven 13, the mold member 1 is assembled and it will be clear that the mold member 1 is here chosen so as to have a cylindrical configuration in order that the external surface thereof may correspond to the inner face of the melting oven 13. After assembly of the mold member 1, the flexible plate-like elements 10' are arranged on the outer surface of the mold member, are deformed into conformity with this surface, are connected with one another by the refractory adhesive substance 11 and fixed to one another by the adhesive strips 12, so as to form the refractory member 10. Thus, the refractory member 10 is rapidly formed on the outer surface of the mold member 1.

The mold member 1 surrounded by the refractory member 10 is placed inside the melting oven 13. It will be understood that the dimensions of the refractory member 10 arranged at the mold member 1 and, in particular, the outer diameter thereof, are chosen to be smaller than the inner diameter of the melting oven 13, so that a space 14 is defined between the outer surface of the refractory member 10 and the inner surface of the melting oven 13. Subsequently to positioning of the mold member 1 surrounded by the refractory member 10, a ramming material is poured into the space 14 and rammed therein by vibration. The refractory adhesive substance 11 connecting the plate-like elements 10', is still not hardened and is sufficiently movable so that it does not hinder deformation of the plate-like elements 10 by the ramming material while the latter is being rammed in the space 12. The plate-like elements 10' are in close contact with the outer surface of the mold member 1 and thereby the ramming material is subject to more intensive ramming action. Approximately 1 or 2 hours after the completion of the ramming, the mold member 1 is disengaged or loosened from the refractory member 10. It is possible because during ramming the refractory adhesive substance 11 is hardened, and thereby the refractory member 10 is converted into a substantially rigid body. The screws 7 and the connecting sections 5 are removed, the segments 2, 3 and 4 are displaced inwardly towards the center of the mold member 1 and thereafter withdrawn from the melting oven 13.

Upon the withdrawal of the mold member 1 from the melting oven 13, the refractory member 10 remains behind to keep the ramming material confined in the space 12, the ramming material is converted into a coherent body constituting a lining for the interior of the melting oven 13. In the present instance, this is accomplished by heating to temperatures which are sufficiently high so as to cause sintering or vitrification of the ramming material to occur. The above rigidification of the lining substance may be performed by admitting liquid metal into the interior of the oven, and particularly, into the interior of the refractory member 10. It will be understood that the refractory member is favorably refractory in order to be able to withstand the high temperatures utilized for sintering or vitrification of the ramming material and to be capable of maintaining the latter confined in the space 14 during such operation when the ramming material has a tendency to grow in volume. The admission of the liquid metal into the interior of the refractory member 10 results in simultaneously heating of the ramming material and subjecting the same to metallostatic pressure. The latter is applied in the direction towards the ramming material and prevents the ramming material from expanding in the direction towards the interior of the oven. This prevents generating the undesirable porousity of the ramming material and provides for essential improvement in solidity of the lining. At the same time, due to the fact that in this case no preheating is needed, the time required for finishing the oven is essentially reduced.

Without further analysis, the foregoing will so fully reveal the gist of the present invention that others can, by applying current knowledge, readily adapt it for various applications without omitting features that, from the standpoint of prior art, fairly constitute essential characteristics of the generic or specific aspects of this invention.

What is claimed as new and desired to be protected by Letters Patent is set forth in the appended claims.

1. A method of lining an article, particularly a melting oven, comprising the steps of providing a mold member with a surface having a configuration substantially corresponding to a face of the article which is to be lined; arranging at said surface a plurality of circumferentially adjacent flexible plate-like elements of a refractory material and connecting said elements with one another so as to form a circumferentially complete refractory member releasably surrounding said mold member; arranging said mold member surrounded by said refractory member, and the article relative to one another so that a space is provided intermediate said refractory member and said face of the article; admitting said lining substance into said space intermediate said refractory member and said face of the article; removing said mold member from said refractory member intact and such a manner that said refractory member remains as a support for said lining substance; rigidifying said lining substance located in said space intermediate said refractory member and said face of the article including sintering of said lining substance after removing said mold member solely by admitting liquid metal into the interior of said refractory member remaining in the melting oven and supporting said lining substance while the melting oven is cold and newly lined so that during sintering said liquid metal supplies heat to and exerts pressure on said lining substance; and using synthetic mica bonded by synthetic resin material, as the refractory material of said flexible plate-like elements, whereby the synthetic mica bonded by synthetic resin material due to its inherent low heat transmission inherently prevents said lining substance from being subjected to an instantaneous temperature shock and thereby inherently prevents the temperature of said lining substance from increasing to the point causing substantial expansion of the latter until at least after the interior of said refractory member has been filled with said liquid metal to a height sufficient for the metallostatic pressure of the liquid metal to resist such expansion.

2. The method as defined in claim 1, wherein said connecting step further includes a step of fixing said elements with one another by adhesive strips.

3. The method as defined in claim 1, wherein said arranging step includes such arranging of said elements that the adjacent end portions of said elements overlap one another, and said connecting step includes adhesively connecting said overlapping proximal end portions to one another.

4. The method as defined in claim 1, wherein said elements have a degree of flexibility sufficient to permit deforming of said elements into conformity to said outer surface of said mold member; and further comprising the step of deforming said elements so as to conform the same to said outer surface.

5. The method as defined in claim 4, wherein said admitting step includes ramming said lining substance in said space intermediate said refractory member and said face of the article, and said step of deforming being performed by said lining substance while the latter is being rammed.

6. The method as defined in claim 1, wherein said connecting step includes a step of adhesively connecting said elements with one another by a refractory adhesive substance.

7. The method as defined in claim 6, wherein said refractory adhesive substance comprises clay, water and aluminum phosphate.

* * * * *